US010450817B2

(12) United States Patent
Rodriguez et al.

(10) Patent No.: US 10,450,817 B2
(45) Date of Patent: Oct. 22, 2019

(54) DISSOLVABLE PROTECTOR SLEEVE

(71) Applicant: HALLIBURTON ENERGY SERVICES, INC., Houston, TX (US)

(72) Inventors: Franklin Charles Rodriguez, Addison, TX (US); Homero De Jesus Maldonado, Dallas, TX (US); Michael Charles Simon, McKinney, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 164 days.

(21) Appl. No.: 15/546,029

(22) PCT Filed: Oct. 11, 2016

(86) PCT No.: PCT/US2016/056429
§ 371 (c)(1),
(2) Date: Jul. 25, 2017

(87) PCT Pub. No.: WO2018/070999
PCT Pub. Date: Apr. 19, 2018

(65) Prior Publication Data

US 2018/0334870 A1 Nov. 22, 2018

(51) Int. Cl.
*E21B 23/02* (2006.01)
*E21B 29/02* (2006.01)
(Continued)

(52) U.S. Cl.
CPC ..... *E21B 23/03* (2013.01); *E21B 17/10* (2013.01); *E21B 23/01* (2013.01); *E21B 23/02* (2013.01); *E21B 29/02* (2013.01); *E21B 7/061* (2013.01)

(58) Field of Classification Search
CPC ..... E21B 29/02; E21B 23/02; E21B 23/00
(Continued)

(56) References Cited

U.S. PATENT DOCUMENTS 8,376,054 B2 2/2013 Lang et al.
9,004,169 B2 4/2015 Huang et al.
(Continued)

FOREIGN PATENT DOCUMENTS

WO WO 2005072354 A1 8/2005
WO WO 2015073001 A1 5/2015

OTHER PUBLICATIONS

International Search Report and Written Opinion for International Application No. PCT/US2016/056429 dated Jul. 7, 2017. (14 pages).

*Primary Examiner* — Kenneth L Thompson
(74) *Attorney, Agent, or Firm* — Haynes and Boone, LLP

(57) ABSTRACT

A downhole tool that includes a tubular member having a first interior passageway, wherein the first interior passageway defines a first surface having a first internal diameter and a second recessed surface having a second internal diameter that is greater than the first internal diameter. The downhole tool also includes a protective sleeve engaged with the second recessed surface, wherein the protective sleeve has a second interior passageway that defines a third surface having a third internal diameter that is substantially equal to the first internal diameter such that the third surface is substantially flush with the first surface. In one embodiment, the protective sleeve is dissolvable upon contact of a fluid having predetermined composition or predetermined temperature such that the sleeve dissolves to expose the recesses formed in the latch assembly.

16 Claims, 6 Drawing Sheets

(51) Int. Cl.

| | |
|---|---|
| ***E21B 23/03*** | (2006.01) |
| ***E21B 17/10*** | (2006.01) |
| ***E21B 23/01*** | (2006.01) |
| *E21B 7/06* | (2006.01) |

(58) Field of Classification Search
USPC ..... 166/376
See application file for complete search history.

(56) References Cited

U.S. PATENT DOCUMENTS

| | | | | |
|---|---|---|---|---|
| 2006/0124319 | A1 | 6/2006 | Mackay | |
| 2007/0039741 | A1* | 2/2007 | Hailey, Jr. | E21B 34/10 166/376 |
| 2008/0099209 | A1 | 5/2008 | Loretz et al. | |
| 2010/0032151 | A1* | 2/2010 | Duphome | E21B 23/02 166/55 |
| 2014/0124214 | A1 | 5/2014 | Mailand et al. | |
| 2014/0190685 | A1 | 7/2014 | Frazier et al. | |
| 2014/0345877 | A1 | 11/2014 | McCoy et al. | |
| 2015/0129205 | A1 | 5/2015 | Hofman et al. | |
| 2016/0326837 | A1* | 11/2016 | Bowen | E21B 34/063 |
| 2018/0328140 | A1* | 11/2018 | Schmidt | E21B 21/103 |

* cited by examiner

DISSOLVABLE PROTECTOR SLEEVE

TECHNICAL FIELD

The present disclosure relates generally to well drilling operations and, more specifically, to a dissolvable protector sleeve used to protect internal profiles of a downhole tool during drilling operations.

BACKGROUND

Latch assemblies often form a portion of the casing string. A latch assembly is generally a casing coupling with an internal profile that mates with spring-loaded keys on the bottom of a whipstock or other multilateral tools. The internal profile of the latch assembly uniquely mates with the keys of the whipstock in only one orientation and depth, enabling repeatable depth and direction control. Generally, the latch assembly provides permanent depth and orientation reference for window exits. Its purpose is to act as a fixed platform for depth and directional control required for accurate setting and retrieval of multilateral tools.

Generally, when a latch assembly forms a portion of the casing string, the internal profile of the latch assembly, such as recesses or pockets of the latch assembly, are exposed to drilling fluids and/or completion fluids. The exposure to drilling fluids and/or completion fluids can erode the internal profile and/or fill the recesses or pockets with debris. Thus, prior to the use of the latch assembly, the internal geometry is cleaned using a cleaning tool and tested using a testing tool that must be run downhole. The running of the cleaning tool downhole may take hours or days, therefore delaying the drilling operations. Even after cleaning is performed by the cleaning tool, the recesses or pockets may be eroded to a point that function of the latch assembly is diminished or reduced.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
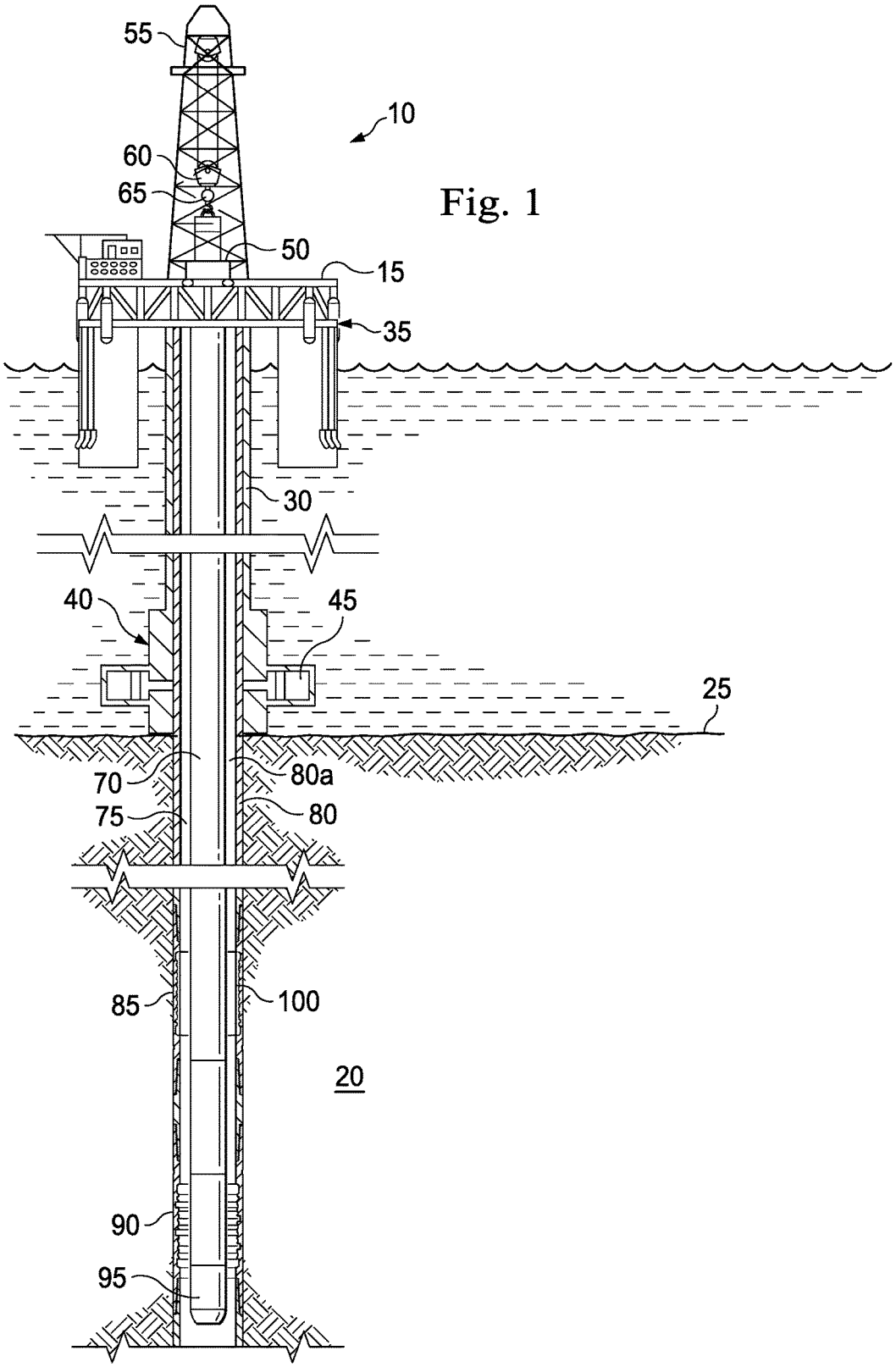
FIG. 1 is a schematic illustration of an oil and gas rig coupled to a protector sleeve and a latch assembly, according to an embodiment of the present disclosure.

Illustrative embodiments and related methods of the present disclosure are described below as they might be employed in a dissolvable protector sleeve and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

FIG. 1 is a schematic illustration of an offshore oil and gas platform generally designated 10, operably coupled by way of example to a dissolvable protective sleeve according to the present disclosure. Such a sleeve could alternatively be coupled to a semi-sub or a drill ship as well. Also, even though FIG. 1 depicts an offshore operation, it should be understood by those skilled in the art that the apparatus according to the present disclosure is equally well suited for use in onshore operations. By way of convention in the following discussion, though FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores or the like.

Referring still to the offshore oil and gas platform example of FIG. 1, a semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. The platform 15 may have a hoisting apparatus 50, a derrick 55, a travel block 60, a hook 65, and a swivel for raising and lowering pipe strings, such as a substantially tubular, axially extending working string 70.

As in the present example embodiment of FIG. 1, a wellbore 75 extends through the various earth strata including the formation 20, with a portion of the wellbore 75 having a casing string or casing 80 cemented therein. The casing 80 may form a passageway 80*a*. Latch assemblies 85 and 90 form a portion of the casing 80, with each latch assembly 85 and 90 being installed together with a pre-milled window (not shown). A whipstock 95, or other multilateral tool, may be secured to the casing 80 using a latch assembly, such as the latch assembly 90. A latch assembly dissolvable sleeve 100 may be accommodated in the latch assembly 85 that protects the latch assembly 85 during drilling and cementing operations but is dissolvable to expose the latch assembly 85 and allow engagement of the latch assembly 85 and a whipstock or other multilateral tool. In an exemplary embodiment, the latch assembly 85 is a casing coupling with an internal profile that mates with spring-loaded keys on the bottom of a whipstock or other multilateral tools. Often, this internal profile uniquely mates with the keys in only one orientation and depth, enabling repeatable depth and direction control. Thus, the latch assembly 85 may provide permanent depth and orientation reference for window exits. Generally, the latch assembly 85 acts as a fixed platform for depth and directional control required for accurate setting and retrieval of multilateral tools.

Figure 2A:
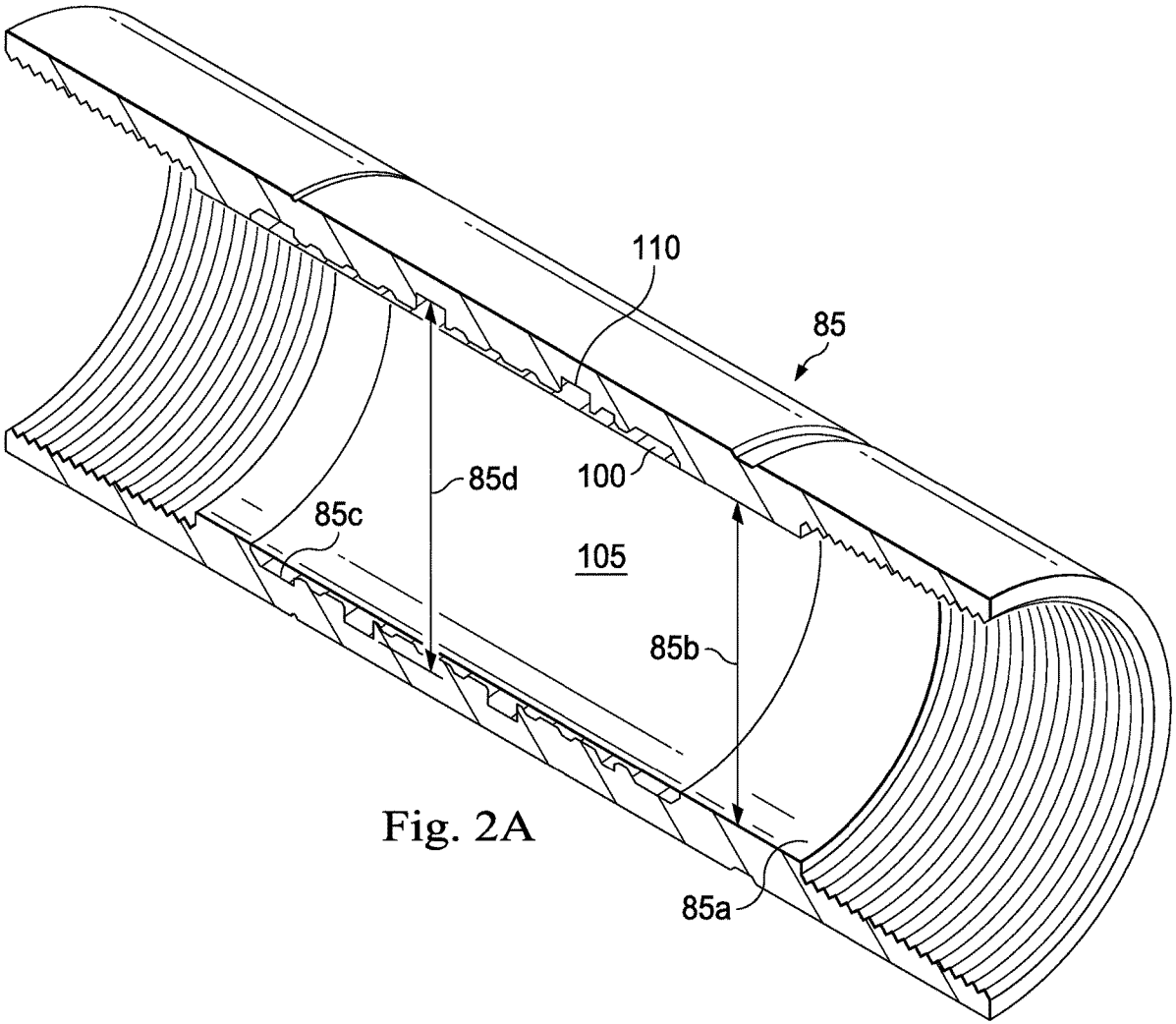
FIG. 2A illustrates a perspective, sectional view of the protector sleeve and the latch assembly of FIG. 1, according to an exemplary embodiment of the present disclosure.
Figure 2B:
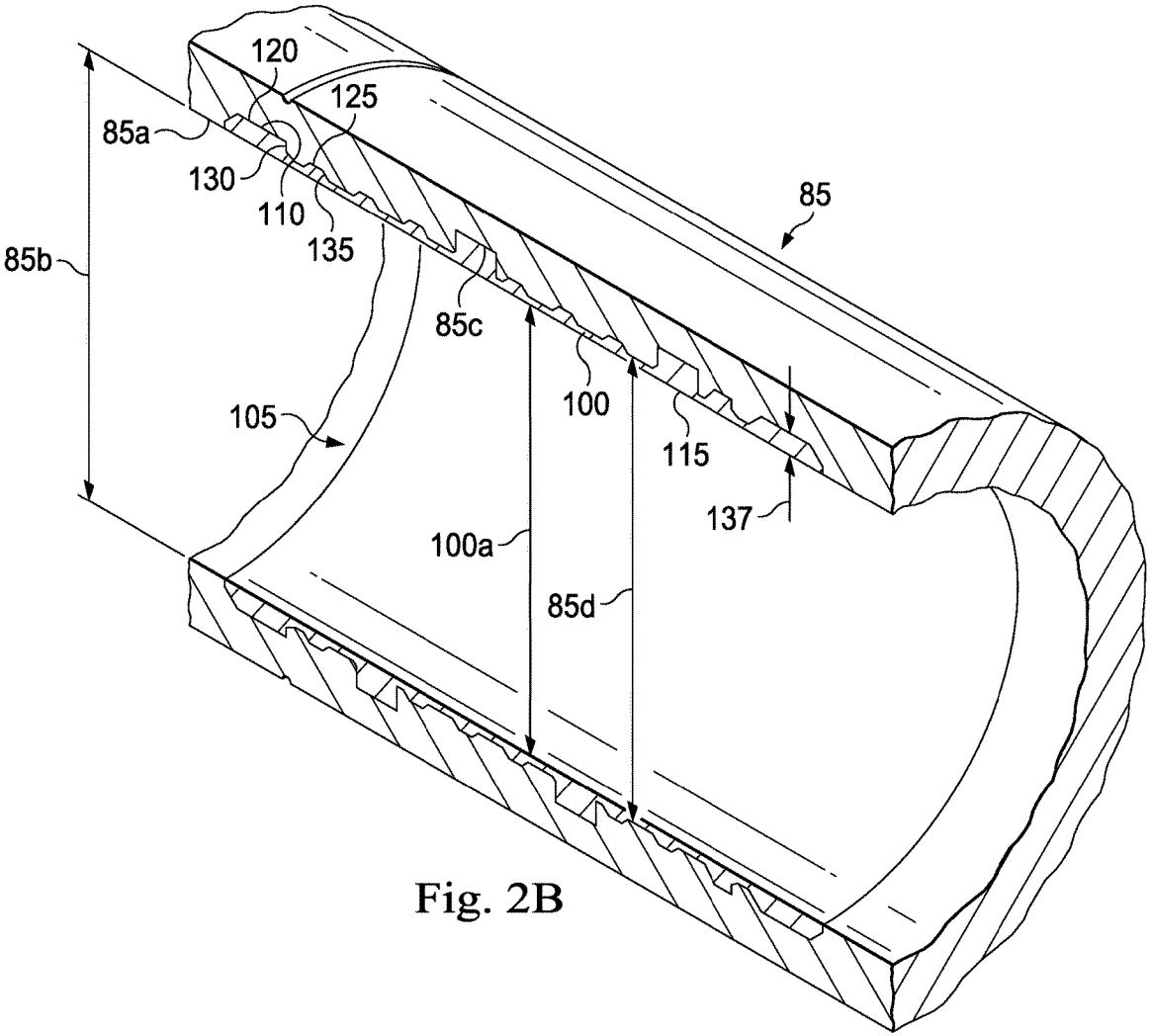
FIG. 2B illustrates a perspective, sectional view of a portion of the protector sleeve and the latch assembly of FIG. 1, according to an exemplary embodiment of the present disclosure.

FIGS. 2A and 2B illustrate the latch assembly 85 and the dissolvable sleeve 100. Generally, the latch assembly 85 is a tubular member that has an interior passageway defining a first internal surface 85*a* having an internal diameter 85*b*. The interior passageway also defines a recessed surface 85*c* having an internal diameter 85*d*. The internal diameter 85*d* is greater than the internal diameter 85*b*. In an exemplary embodiment, the internal diameter 85*d* is variable along a length of the latch assembly 85. The internal geometry of the latch assembly 85 is formed by the recessed surface 85*c*. The sleeve 100 is also a tubular member that forms a longitudinally extending, interior fluid passageway 105. The sleeve 100 has an external surface 110 that conforms to and engages with the recessed surface 85*c* of the latch assembly 85. The sleeve 100 has an interior surface 115 that defines the passageway 105 and an internal diameter 100*a* of the sleeve 100. The external surface 110 may form protrusions 120 and 125 that are accommodated in corresponding recesses, such as recesses 130 and 135, formed by the recessed surface 85*c* within the latch assembly 85. Generally, the corresponding recesses 130 and 135 are latch pockets or other types of internal geometries designed to latch or mate with a downhole tool. However, the recessed surface 85*c* can form a variety of geometries, such as one or more longitudinally extending recesses in the latch assembly, one or more circumferentially extending recesses in the latch assembly, and any combination thereof. Generally, a thickness 137 of the sleeve 100 is variable along a length of the sleeve (measured in the longitudinal direction of the sleeve 100) such that the internal diameter 85*b* is equal or substantially equal (i.e., with 10% of the internal diameter 85*b*) to the internal diameter 100*a* of the sleeve 100. In one embodiment, the variable thickness 137 is a function of a difference between the internal diameter 85*b* and the internal diameter 85*d*. In an exemplary embodiment, at any point on the sleeve 100, the thickness 137 is the half the difference between the internal diameter 85*b* and the internal diameter 85*d*. In other words, the sleeve 100 "fills" the recesses 130 and 135 formed within the latch assembly 85 so that the internal diameter 100*a* of the sleeve 100 is flush with the internal diameter 85*b* of the latch assembly 85 and the internal diameter 80*b* of the casing 80. As such, the interior surface 115 is substantially flush with the first surface 85*a*. As shown, the protective sleeve 100 is concentrically disposed within the latch assembly 85 and the interior surface 115 is substantially flush with the first surface 85*a* along an entirety of the protective sleeve 100 in the longitudinal direction. In one exemplary embodiment, the external surface 110 engages the entirety of the recessed surface 85*c* in the longitudinal direction, in the circumferential direction, or both. Therefore, the sleeve 100 is a full-internal-diameter-access sleeve 100.

The recesses 130 and 135 may form at least a portion of a nipple profile, a "rest on no-go", "snap in", "drop off", and "lock in" type configurations for securing or locking a downhole tool to the latch assembly 85.

The sleeve 100 may be composed of a first material is a hardened dissolvable compound that reacts upon exposure to a first fluid. That is, the first material is a dissolvable material. In an exemplary embodiment, the first material is, such as for example, a metal including aluminum, magnesium, zinc, iron, alloys of these metals and the like; a plastic including a polymer; or any combination thereof.

The latch assembly 85 may be any type of tool that has a nipple profile, or other internal geometry, that may be damaged during completion operations or any other type of downhole operations or well intervention activities. Generally, the latch assembly 85 is composed of a material that is different from the first material of the sleeve 100.

Figure 3:
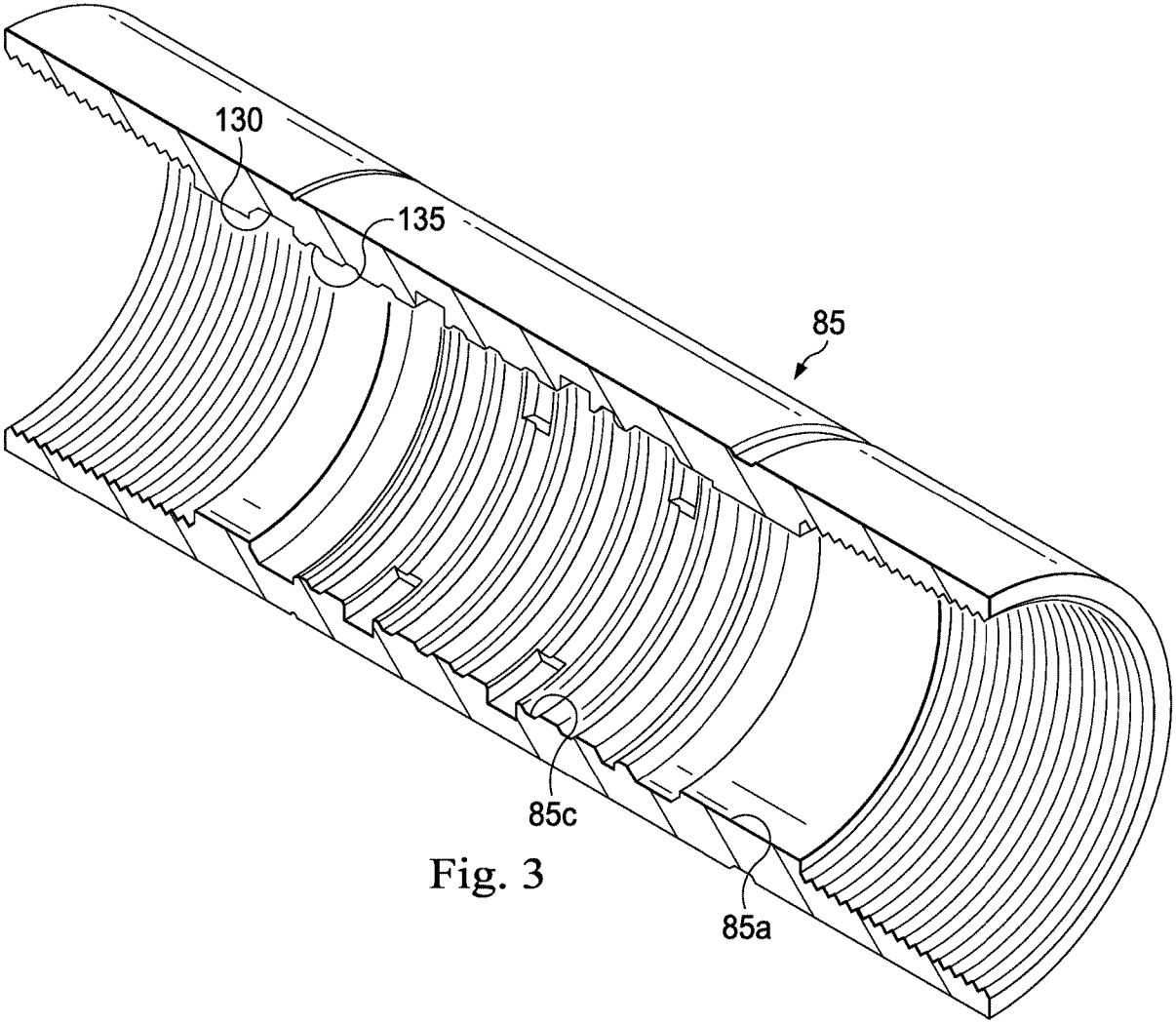
FIG. 3 illustrates a perspective, sectional view of the latch assembly of FIG. 1, according to an exemplary embodiment of the present disclosure.

In operation and in one embodiment, the sleeve 100 is coupled to the latch assembly 85 prior to running the latch assembly 85 downhole. The sleeve 100 may be adhered to the latch assembly 85 or may form a friction fit with the latch assembly 85 to couple the sleeve 100 to the latch assembly 85. The latch assembly 85 and sleeve 100 is then positioned downhole. When the latch assembly 85 forms a portion of the casing 80, the casing 80 and the latch assembly 85 are then cemented in place within the wellbore 75. Drilling operations may begin, such that, for example, drilling debris and/or fluids may pass over the latch assembly 85 and the sleeve 100. The sleeve 100, when coupled to the latch assembly 85, isolates and protects the internal geometry of the latch assembly 85, such as for example the recesses 130 and 135, from liquids and/or solids that pass through the passageway 105 and the passageway 80*a* formed within the casing 80. That is, the sleeve 100 prevents drilling debris and/or fluids from entering the recesses 130 and 135 of the latch assembly 85. After a certain period of time after exposure to the first fluid, which may be present in the wellbore 75 when the latch assembly 85 is positioned in the wellbore 75 or may be introduced into the wellbore 75 later, the sleeve 100 is dissolved and/or weakened such that the sleeve 100 unlocks and breaks away from the latch assembly 85. Thus, the sleeve 100 dissolves into a plurality of pieces that are flushed down, or up, the interior passageway 80*a* of the casing 80 to reveal the previously-protected internal geometry of the latch assembly 85, as depicted in FIG. 3.

In one or more exemplary embodiments, the sleeve 100 begins to dissolve and weaken when exposed to the first fluid within the wellbore 75, which may be present in the wellbore 75 prior to the sleeve 100 locking to the latch assembly 85, may be introduced prior to the start of completion operations, may be introduced during completion operations, may be introduced after the completion operations, or may be introduced anytime in-between. Regardless, upon the injection of the first fluid through the sleeve 100, the sleeve 100 begins to dissolve and weaken. The first fluid dissolves the sleeve 100 at a rate such that the sleeve 100 unlocks at a predetermined time or time range. In an exemplary embodiment, the dissolution rate of the sleeve 100 is dependent upon the first fluid and the temperature of the first fluid within the wellbore 75. In an exemplary embodiment, the temperature of the first fluid within the wellbore 75 is between about 80° F. and 300° F. In an exemplary embodiment, it is the temperature of the first fluid, independent of the composition of the first fluid, that will cause the sleeve 100 to react and dissolve and weaken. In an exemplary embodiment, the first fluid may include a chemical that alters the chemical composition of the sleeve 100 to dissolve and weaken the sleeve 100. In another exemplary embodiment, the first fluid may be any type of fluid (e.g., oil-based mud, water-based mud, etc.) that is circulated at a temperature which causes the sleeve 100 to react to the change in temperature to dissolve and weaken. In one or more exemplary embodiments, the first fluid may be, such as for example, any one of an acid, a carboxylic acid, a sulfonic acid, an organic acid, a sulfuric acid, a hydrochloric acid, a nitric acid, an inorganic acid, an ammonium, a Lewis acid, a base, a hydroxide, a potassium hydroxide, a sodium hydroxide, a strong base, an acetone, a Lewis base, a gasoline, a hydrocarbon, an alcohol, water, and a chloride. In one or more examples, the first fluid may be a completion fluid, production hydrocarbons, a slurry, etc.

Thus, the sleeve 100 protects the internal geometry (i.e., the recessed surface 85*c*) of the latch assembly 85 from erosion damage or other types of damage when the drilling fluids pass through the passageway 105 of the protective sleeve 100 at high flow rates that are often associated with completion and/or drilling operations. The sleeve 100 is a sacrificial sleeve that protects components of the latch assembly 85 from erosion damage and then dissolves within a predetermined amount of time when exposed to the first fluid. Thus, a cleaning run to remove residue from the internal geometry of the latch assembly 85, including for example the recesses 130 and 135, is avoided. In an exemplary embodiment, the sleeve 100 does not require retrieval after it is coupled to the latch assembly 85. As such, the sleeve 100 avoids time spent and costs associated with a protective sleeve retrieval. Thus, the sleeve 100 is used to protect interior-facing tool components or internal geometries of tools from drilling fluids and/or slurries injected at high flow rates. In an exemplary embodiment and due to the sleeve 100 dissolving to expose the internal geometry of the latch assembly 85, the sleeve 100 has a tool-less release mechanism or is a self-removing sleeve. As such, mechanical release mechanisms found in conventional protectors are not necessary, which simplifies the design and manufacture (and thus the cost) of the sleeve 100. Additionally, and in some exemplary embodiments, the sleeve 100 protects the internal geometry of the latch assembly 85 independently of any gaskets or seals, which often may affect (i.e., reduce) the pressure integrity of the sleeve 100 and/or latch assembly 85. Thus, as the sleeve 100 is a seal-less sleeve, the use of the sleeve 100 does not reduce the pressure integrity of the protected (via the use of the sleeve 100) latch assembly 85. That is, the pressure integrity of the combination of the sleeve 100 and the latch assembly 85 is the pressure integrity of the latch assembly 85.

Damage to the internal geometry of the latch assembly 85 after well completion can occur in various ways. The erosion of the internal geometry of the latch assembly 85 can occur during flow back and scale build-up can hinder or prevent future latch-ins. When this occurs, the internal geometry of the latch assembly 85 may not fully engage or only or partially engage, thereby decreasing the ability of the whipstock 95 to hold a load or torque. Thus, and in some embodiments, there is a need for application of a replacement sleeve or a sleeve 100' to the latch assembly 85. In an exemplary embodiment, the sleeve 100' is identical to or nearly identical to the sleeve 100. In an exemplary embodiment, the sleeve 100' may be applied to the latch assembly 85 after the sleeve 100 has been released from the latch assembly 85. Alternatively, the sleeve 100' may be applied in situ to any latch assembly. In an exemplary embodiment, a sleeve applicator applies the sleeve 100' to the latch assembly 85. In an exemplary embodiment, the sleeve applicator is similar to a packer in that the sleeve applicator provides a seal above and below (along the longitudinal axis of the casing 80) the latch assembly 85. However, the sleeve applicator may also be a syringe style applicator.

Figure 4:
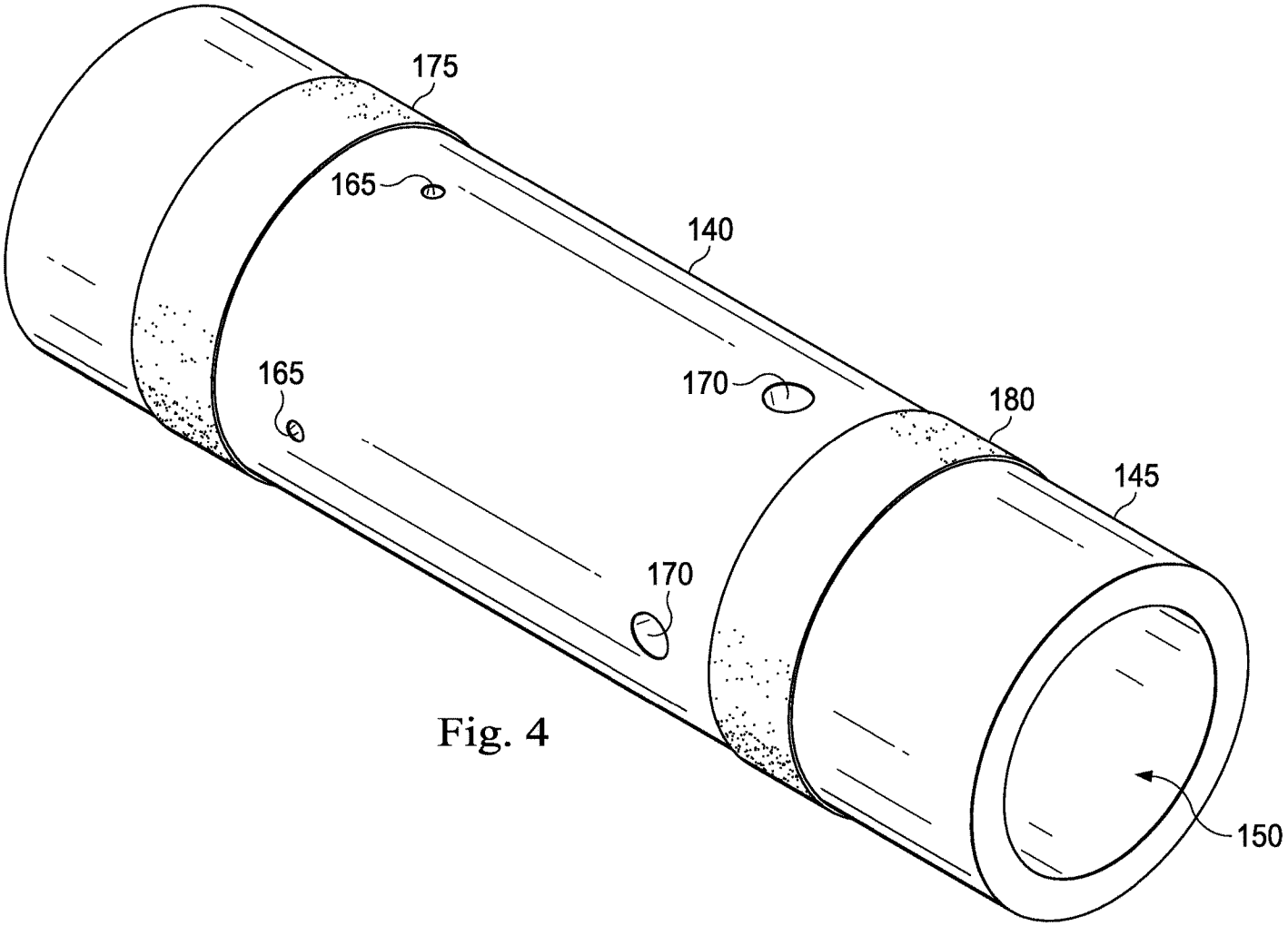
FIG. 4 illustrates a perspective view of a sleeve application tool, according to an exemplary embodiment of the present disclosure.
Figure 5:
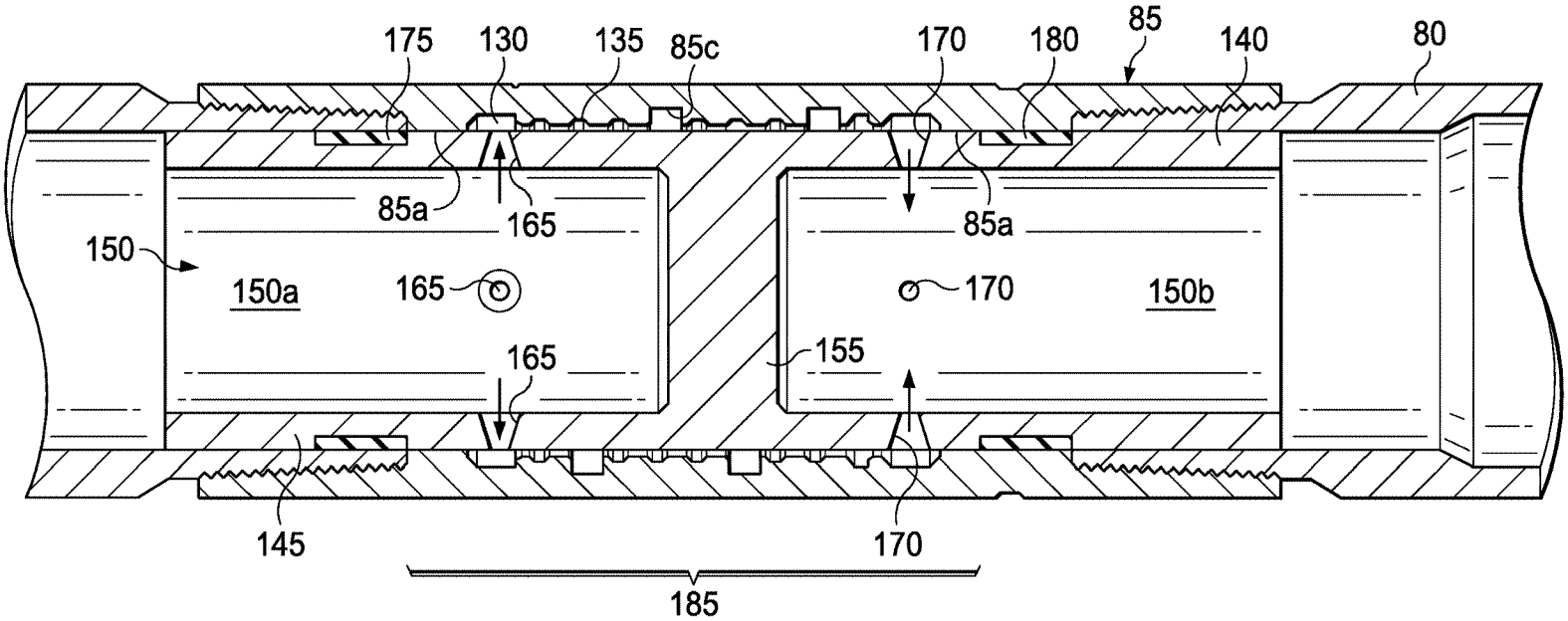
FIG. 5 illustrates a sectional view of the latch assembly of FIG. 3 and the sleeve application tool of FIG. 4, according to an exemplary embodiment of the present disclosure.

FIGS. 4 and 5 illustrate an embodiment of the sleeve applicator and is generally referred to by the numeral 140. In an exemplary embodiment, a cross-sectional view of the applicator along a longitudinal axis of the applicator 140 generally forms an "H" shape. That is, the applicator 140 includes a cylindrical tube 145 forming a passageway 150. The applicator 140 includes a webbing 155 that extends across the entirety of the passageway 150 to divide a first portion 150*a* of the passageway 150 from a second portion 150*b* of the passageway 150. That is, the webbing 155 prevents fluid from flowing longitudinally through the passageway 150 and spaces the first portion 150*a* from the second portion 150*b* longitudinally. The applicator 140 also includes a plurality of holes 165 that extend through the wall of the tube 145, with each of the holes 165 allowing a fluid to flow from through the tube 145 and out of the first portion 150*a* of the passage and/or into the first portion 150*a* of the passage. The applicator 140 also includes a plurality of holes 170 that extend through the wall of the tube 145, with each of the holes 170 allowing a fluid to flow from through the tube 145 and out of the second portion 150*b* of the passageway and/or into second portion 150*b* of the passageway 150. The applicator 140 also includes two seals 175 and 180 spaced longitudinally along the exterior of the tube 145 such that the plurality of holes 165 and plurality of holes 170 are located between the seals 175 and 180. In operation, the applicator 140 is positioned within the passageway of the latch assembly 85 such that the internal geometry of the latch assembly 85 is positioned between the seals 175 and 180. After the seals 175 and 180 are sealingly engaged with the surface 85*a* of the latch assembly 85, a fluidic dissolvable compound is flowed through the first portion 150*a* of the passage and out of the first portion 150*a* of the passage through the plurality of holes 165. The fluidic dissolvable compound displaces any fluid located within a cavity formed between the latch assembly 85 and the applicator 140 and between the seals 175 and 180 (i.e., the application zone 185). The application zone 185 is defined at least partially in the longitudinal direction by the seals 175 and 180 and in the radial direction by the recessed surface 85*c* and/or the surface 85*a* and an external surface of the tube 145. The displaced fluid is forced out of the application zone 185 and into the second portion 150*b* of the passageway via the plurality of holes 170. The fluidic dissolvable compound is then accommodated within the application zone 185 to form the sleeve 100'. That is, the fluidic dissolvable compound is accommodated within the internal geometry (e.g., the recesses 130 and 135). The amount of fluidic dissolvable compound required to be pumped downhole is determined at least in part by the internal diameter of the tubing that conveys the dissolvable compound downhole. In an exemplary embodiment, the applicator 140 rotates relative to the latch assembly 85 to ensure a smooth surface when the outer diameter of the applicator 140 has similar helical features (material) as the washover assembly. The fluidic dissolvable compound is then hardened to become the first material.

In an exemplary embodiment, the internal diameter 100*a* of the sleeve 100 is consistent or substantially consistent (within 10%) throughout the length (measured along the longitudinal axis of the sleeve 100) of the sleeve 100. That is, the material of the sleeve 100 fills the recesses 130 and 135 such that the internal diameter 100*a* of the sleeve 100 is the equal to or substantially equal to as the internal diameter 80*b* of the casing 80. Thus, the sleeve 100 and/or the sleeve 100' is a full-internal-diameter access sleeve. Therefore, as the sleeve 100 is flush with the casing 80, the flow of fluid through the sleeve 100 is more laminar, and less turbulent, compared to protective sleeves having variable internal diameters and/or internal diameters that are different from the casing 80. Moreover, as the sleeve 100 has a consistent internal diameter 100*a*, there are no recesses formed within the interior surface 115 of the sleeve 100 in which debris can accumulate. Thus, a run to clean out those recesses is avoided.

In an exemplary embodiment, the sleeve 100 and/or the sleeve 100' protects the internal geometry of the latch assembly 85 (e.g., the recesses 130 and 135, etc.) with the dissolvable compound or the first material, that will isolate the internal geometry of the latch assembly 85 from debris and residues generated from drilling and cementing operations. Once drilling and cementing operations are completed, the first material will be dissolved to expose the internal geometry of the latch assembly 85 entirely. The first material may be dissolved either by being in contact with a special type of fluid, such as the first fluid, or by been exposed to a change in temperature. Once the internal geometry of the latch assembly 85 is exposed, latch keys (of other downhole tools) may engage with at least a portion of the internal geometry of the latch assembly 85 to provide a fixed support required for installation of multilateral tools. The sleeve 100 and/or 100' may save a trip downhole to clean the internal geometry of the latch assembly 85 from any debris generated in cementing or drilling operations.

In an exemplary embodiment, the sleeve 100 may be applied to the latch assembly 85 at the surface of the well and prior to the latch assembly 85 being run downhole and the sleeve 100' may be applied to the latch assembly 85 when the latch assembly 85 is cemented in place downhole. Regardless, this in situ application of the sleeve 100 and/or the sleeve 100' results in a customized sleeve capable of accommodating and protecting any variety of interior geometries for any variety of downhole tools. Thus, the time and money required to design and machine a traditional protective sleeve is avoided.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a dissolvable protector sleeve has been described. Embodiments of the apparatus may generally include a tubular member having a first interior passageway, wherein the first interior passageway defines: a first surface having a first internal diameter; and a second recessed surface having a second internal diameter that is greater than the first internal diameter; and a protective sleeve engaged with the second recessed surface, wherein the protective sleeve has a second interior passageway that defines a third surface having a third internal diameter that is substantially equal to the first internal diameter such that the third surface is substantially flush with the first surface; wherein the protective sleeve is composed of a dissolvable material. For any of the foregoing embodiments, the method may include any one of the following, alone or in combination with each other:

- The tubular member is a latch assembly and the second recessed surface forms a latch pocket.
- The protective sleeve has a variable thickness along a length of the protective sleeve that is a function of a difference between the second internal diameter and the first internal diameter.
- The dissolvable material is dissolvable upon contact with a fluid.
- The fluid comprises at least one of an acid, an ammonium, a base, an hydroxide, an acetone, a gasoline, a hydrocarbon, an alcohol, water, and a chloride.
- The dissolvable material is dissolvable upon a change in temperature.
- The second recessed surface forms a plurality of a longitudinally extending recesses in the tubular member.
- The second recessed surface forms a plurality of circumferentially extending recesses in the tubular member.
- An external surface of the protective sleeve engages the entirety of the second recessed surface in a longitudinal direction.
- An external surface of the protective sleeve engages the entirety of the second recessed surface in a circumferential direction.
- The protective sleeve is removable from the tubular member without the use of a mechanical release mechanism.
- The third surface is substantially flush with the first surface along an entirety of the protective sleeve in the longitudinal direction of the protective sleeve.
- The protective sleeve is concentrically disposed within the tubular member, and wherein the entirety of the third surface is substantially flush with the first surface.

Thus, a method of installing a protective sleeve within a latch assembly that forms a portion of a casing string has been described. In an exemplary embodiment, the method includes positioning a tool within a first interior passageway formed by the latch assembly, wherein the tool forms a second interior passageway and comprises a webbing extending radially across the entirety of the second interior passageway to define a first portion of the second interior passageway and a second portion of the second interior passageway that is longitudinally spaced from the first portion of the second interior passageway by the webbing; sealingly engaging a first and second seal that are longitudinally spaced along an external surface of the tool with an interior surface of the latch assembly to define an application zone that extends longitudinally along the latch assembly and is defined in a longitudinal direction by at least the first and second seals and defined in a radial direction by at least the external surface of the tool and the interior surface of the latch assembly; flowing a first fluid into the first portion of the second interior passageway and through a plurality of holes extending through a wall of the tool and into the application zone; and hardening the first fluid in the application zone to form the protective sleeve; wherein the protective sleeve is composed of a dissolvable material. For any of the foregoing embodiments, the method may include any one of the following, alone or in combination with each other:

The interior surface of the latch assembly includes a first surface having a first internal diameter; and a second recessed surface having a second internal diameter that is greater than the first internal diameter.

After hardening the first fluid in the application zone to form the protective sleeve, an external surface of the protective sleeve is engaged with the second recessed surface.

The protective sleeve defines a third internal surface forming a third interior passageway.

Injecting a second fluid through the third interior passageway after hardening the first fluid in the application zone.

The second recessed surface is shielded from the second fluid when covered by the protective sleeve.

Injecting a third fluid through the third interior passageway after hardening the first fluid in the application zone.

Dissolving the protective sleeve using the third fluid.

The third fluid includes at least one of an acid, an ammonium, a base, an hydroxide, an acetone, a gasoline, a hydrocarbon, an alcohol, water, and a chloride.

The protective sleeve is dissolved based on a temperature of the third fluid.

Exposing the second recessed surface of the latch assembly after the protective sleeve is dissolved using the third fluid.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A downhole tool, the downhole tool comprising:

a tubular member having a first interior passageway, wherein the first interior passageway defines:

a first surface having a first internal diameter; and a second recessed surface having a second internal diameter that is greater than the first internal diameter; and a protective sleeve engaged with the second recessed surface, wherein the protective sleeve has a second interior passageway that defines a third surface having a third internal diameter that is substantially equal to the first internal diameter such that the third surface is substantially flush with the first surface;

wherein the protective sleeve is composed of a dissolvable material; and wherein the second recessed surface forms a plurality of a longitudinally extending recesses in the tubular member and/or forms a plurality of circumferentially extending recesses in the tubular member.

2. The downhole tool of claim 1, wherein the tubular member is a latch assembly and the second recessed surface forms a latch pocket.

3. The downhole tool of claim 1, wherein the protective sleeve has a variable thickness along a length of the protective sleeve that is a function of a difference between the second internal diameter and the first internal diameter.

4. The downhole tool of claim 1, wherein the dissolvable material is dissolvable upon contact with a fluid.

5. The downhole tool of claim 4, wherein the fluid comprises at least one of an acid, an ammonium, a base, an hydroxide, an acetone, a gasoline, a hydrocarbon, an alcohol, water, and a chloride.

6. The downhole tool of claim 1, wherein the dissolvable material is dissolvable upon a change in temperature.

7. The downhole tool of claim 1, wherein an external surface of the protective sleeve engages the entirety of the second recessed surface in a longitudinal direction.

8. The downhole tool of claim 1, wherein an external surface of the protective sleeve engages the entirety of the second recessed surface in a circumferential direction.

9. The downhole tool of claim 1, wherein the protective sleeve is removable from the tubular member without the use of a mechanical release mechanism.

10. A method of installing a protective sleeve within a latch assembly that forms a portion of a casing string, the method comprising:

positioning a tool within a first interior passageway formed by the latch assembly, wherein the tool forms a second interior passageway and comprises a webbing extending radially across the entirety of the second interior passageway to define a first portion of the second interior passageway and a second portion of the second interior passageway that is longitudinally spaced from the first portion of the second interior passageway by the webbing;

sealingly engaging a first and second seal that are longitudinally spaced along an external surface of the tool with an interior surface of the latch assembly to define an application zone that extends longitudinally along the latch assembly and is defined in a longitudinal direction by at least the first and second seals and defined in a radial direction by at least the external surface of the tool and the interior surface of the latch assembly;

flowing a first fluid into the first portion of the second interior passageway and through a plurality of holes extending through a wall of the tool and into the application zone; and hardening the first fluid in the application zone to form the protective sleeve;

wherein the protective sleeve is composed of a dissolvable material;

wherein the interior surface of the latch assembly comprises:

a first surface having a first internal diameter; and a second recessed surface having a second internal diameter that is greater than the first internal diameter; and wherein the second recessed surface forms a plurality of a longitudinally extending recesses in the latch assembly and/or forms a plurality of circumferentially extending recesses in the latch assembly; and wherein the protective sleeve has a third interior passageway that defines a third surface having a third internal diameter that is substantially equal to the first internal diameter such that the third surface is substantially flush with the first surface.

11. The method of claim 10, wherein after hardening the first fluid in the application zone to form the protective sleeve, an external surface of the protective sleeve is engaged with the second recessed surface.

12. The method of claim 11, wherein the method further comprises injecting a second fluid through the third interior passageway after hardening the first fluid in the application zone; and wherein the second recessed surface is shielded from the second fluid when covered by the protective sleeve.

13. The method of claim 12, further comprising:

injecting a third fluid through the third interior passageway after hardening the first fluid in the application zone; and dissolving the protective sleeve using the third fluid.

14. The method of claim 13, wherein the third fluid comprises at least one of an acid, an ammonium, a base, an hydroxide, an acetone, a gasoline, a hydrocarbon, an alcohol, water, and a chloride.

15. The method of claim 13, wherein the protective sleeve is dissolved based on a temperature of the third fluid.

16. The method of claim 13, further comprising exposing the second recessed surface of the latch assembly after the protective sleeve is dissolved using the third fluid.

* * * * *